United States Patent [19]

Göbbels et al.

[11] Patent Number: 4,716,718

[45] Date of Patent: Jan. 5, 1988

[54] OPEN-END ROTOR SPINNING MACHINE

[75] Inventors: Heinz-Dieter Göbbels, Moenchengladbach; Manfred Lassmann, Nettetal; Hans Raasch; Norbert Schippers, both of Moenchengladbach, all of Fed. Rep. of Germany

[73] Assignee: W. Schlafhorst & Co., Moenchengladbach, Fed. Rep. of Germany

[21] Appl. No.: 858,394

[22] Filed: May 1, 1986

[30] Foreign Application Priority Data

May 2, 1985 [DE] Fed. Rep. of Germany ..... 3515765

[51] Int. Cl.[4] ..... D01H 15/02; D01H 13/16

[52] U.S. Cl. ..... 57/263; 57/81; 57/264; 57/405

[58] Field of Search ..... 57/261-265, 57/80, 81, 405

[56] References Cited

U.S. PATENT DOCUMENTS

| | | | |
|---|---|---|---|
| 4,007,457 | 2/1977 | Aeppli | 57/264 |
| 4,137,699 | 2/1979 | Stahlecker et al. | 57/264 |
| 4,276,742 | 7/1981 | Raasch et al. | 57/263 |
| 4,541,233 | 9/1985 | Raasch et al. | 57/263 |
| 4,541,235 | 9/1985 | Raasch | 57/263 |
| 4,660,365 | 4/1987 | Raasch | 57/263 |

*Primary Examiner*—John Petrakes

*Attorney, Agent, or Firm*—Herbert L. Lerner; Laurence A. Greenberg

[57] ABSTRACT

An open-end rotor spinning machine includes a plurality of spinning stations each including a first thread monitor monitoring a thread course and a rotor spinning device receiving a fiber supply and having a spinning element; an automatic thread joining device for joining a thread to be conducted to the rotor element, and a second thread monitor disposed on the automatic thread joining device for monitoring the thread course without placing a load on the thread when the first thread monitor is inoperative and the automatic thread joining device is operative, the automatic device delivering the second thread monitor and a thread to a location directly adjacent the spinning element, and the second thread monitor including a device for immediately interrupting the fiber supply to the rotor spinning device if the second thread monitor detects the absence of the thread.

6 Claims, 8 Drawing Figures

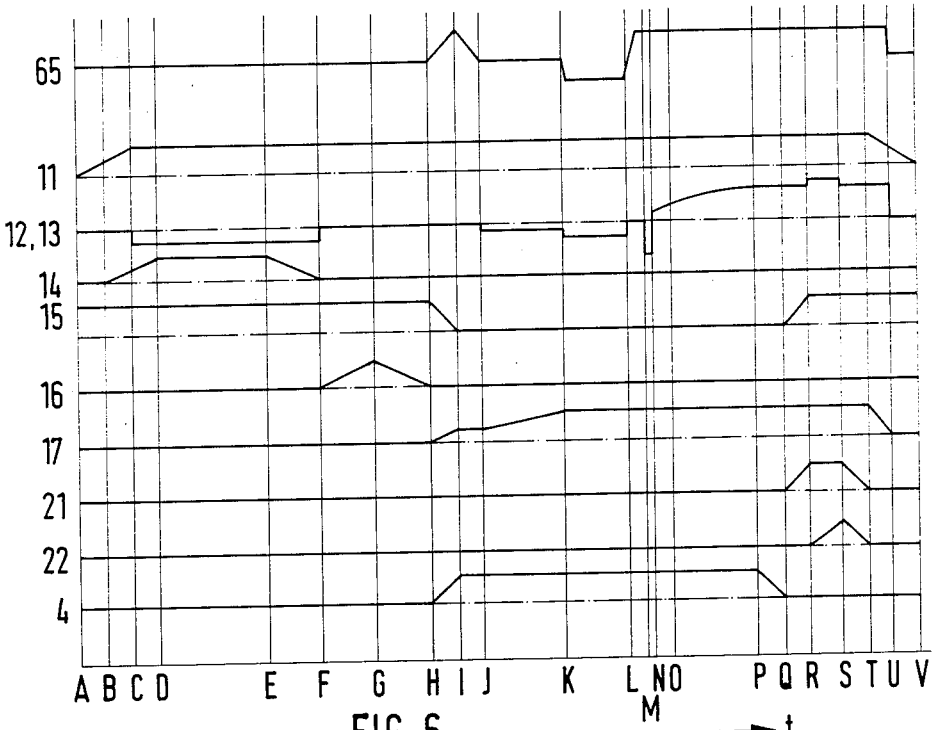
FIG. 6
FIG. 7
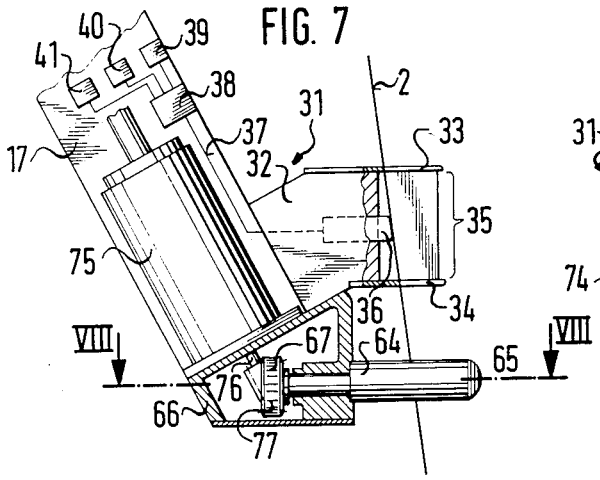
FIG. 8
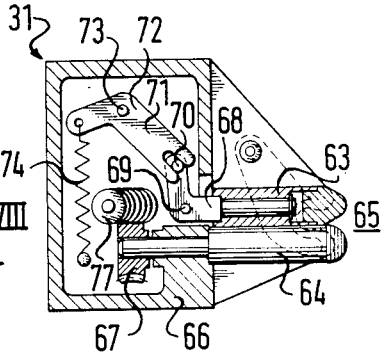

OPEN-END ROTOR SPINNING MACHINE

The invention relates to an open-end rotor spinning machine, including a thread monitor at each spinning station and an automatic device for joining or piecing the thread or for starting the spinning operation by joining or piecing the thread which is to be introduced into the rotor.

In order to join or piece the thread or to start the spinning operation, the thread monitor of the spinning station must be moved to the side or disabled, in order to make it possible to return the thread to the rotor and to perform the joining or piecing or the start of the spinning operation in an undisturbed manner. The monitoring of the thread can be resumed a certain time after the joining or piecing or start of the spinning operation, and during this time a small rotor can be over-filled with fibers at a high spinning speed, if the joining or piecing or spinning start is not successful.

Over-filling the rotor may cause a fire, or lead to the destruction of the rotor.

It is accordingly an object of the invention to provide an opened rotor spinning machine which overcomes the hereinafore-mentioned disadvantages of the heretofore-known devices of this general type, to provide a continuous monitoring of the thread, and to provide a rapid response to the absence of the thread, which not only makes it possible to avoid extensive operating disturbances and accidents but also permits the use of smaller rotors at greater spinning velocities.

With the foregoing and other objects in view there is provided, in accordance with the invention, an open-end rotor spinning machine, comprising a plurality of spinning stations each including a first thread monitor monitoring a thread course and a rotor spinning device receiving a fiber supply and having a spinning element; an automatic thread joining device for joining a thread or for starting a spinning operation of a thread to be conducted to the rotor element, and a second thread monitor disposed on the automatic thread joining device for monitoring the thread course without placing a load on the thread when the first thread monitor is inoperative and the automatic thread joining device is operative, the automatic device including means for delivering the second thread monitor and a thread to a location directly adjacent or as close as possible to the spinning element, and the second thread monitor including means for immediately interrupting the fiber supply to the rotor spinning device if the second thread monitor detects the absence of the thread.

In accordance with another feature of the invention, the second thread monitor includes means for initiating a repetition of he operation of the automatic thread joining device, means for ending the operation of the automatic thread joining device after at least one or more unsuccessful repetitions, and means for issuing a malfunction signal.

In accordance with a further feature of the invention, the second thread monitor also includes means for initiating a repetition of the operation of the automatic thread joining device after a rotor cleaning operation.

In accordance with an added feature of the invention, the delivering means includes a thread regulator having a head end on which the second thread monitor is disposed, and the spinning element is a rotor having a feed tube at the location in front of or into which the thread is conducted.

In accordance with an additional feature of the invention, the head end of the thread regulator also includes a thread joint tester measuring at least one of the thickness and thinness of the thread or both.

In accordance with again another feature of the invention, the second thread monitor and the thread joint tester are combined into one device.

In accordance with again a further feature of the invention, the device combining the second thread monitor and the thread joint tester has a single measuring range and a measuring element responding to the absence of the thread and to thicker and thinner portions of the thread for activating the interrupting means, for activating a repetition of the operation of the automatic thread joining device, for ending the operation of the automatic thread joining device after at least one unsuccessful repetition of the operation of the thread joining device, and for issuing a malfunction signal.

In accordance with a concomitant feature of the invention, the measuring element also initiates a rotor cleaning operation.

Other features which are considered as characteristic for the invention are set forth in the appended claims.

Although the invention is illustrated and described herein as embodied in an open-end rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 6 is a motion or control diagram;

FIG. 7 is a fragmentary, partially cross-sectional view of the head end of the thread regulator or feeder of the device for starting the spinning operation or joining the thread; and FIG. 8 is a cross-sectional view taken along the line VIII—VIII in FIG. 7, in the direction of the arrows.

Figure 1:
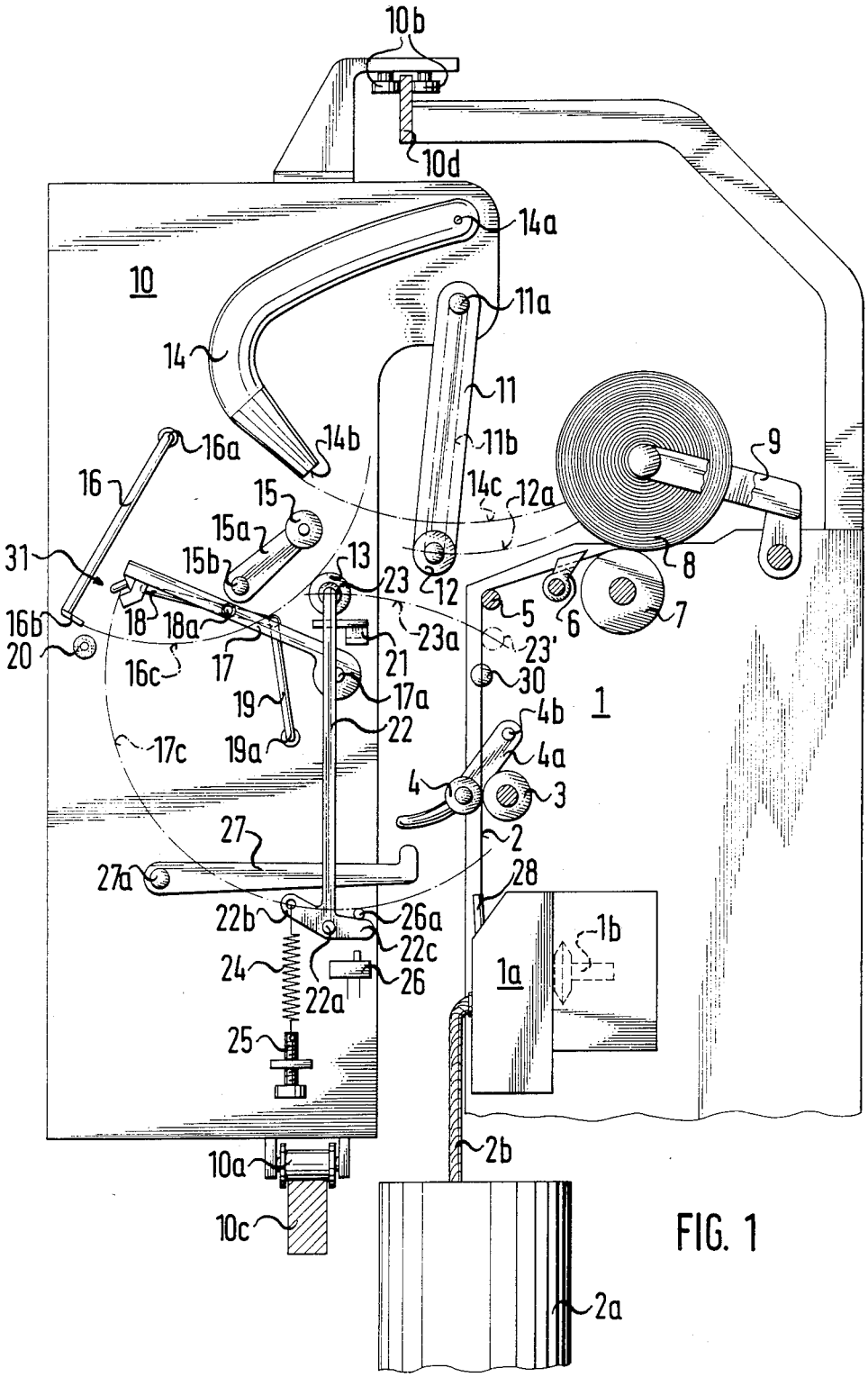
FIG. 1 is a fragmentary, diagrammatic, side-elevational view of a spinning station and a device for starting the spinning operation or piecing the thread.

Referring now to the figures of the drawings in detail and first, particularly, to FIG. 1 thereof, it is seen that a spinning station 1 has a rotor spinning device 1*a* with a rotor or spinning element 1*b*.

During normal operation, a spun thread 2 is conducted through a thread unwinding or take-off device, which is formed of a pair of unwinding or take-off rollers with an unwinding or takeoff roller 3 and a clamping roller 4. The thread 2 is pulled out from the rotor spinning device 1*a* with constant speed by the thread unwinding device. Following the unwinding roller 3, the thread 2 runs past a first thread monitor 30 over a deflection or guiding bar 5, through a thread guide 6 and over a winding or take-up roller 7 onto a winding bobbin or take-up spool 8. The winding bobbin 8 is driven with constant speed by friction from the winding roller 7. The winding bobbin 8 is supported in a bobbin frame 9.

In front of the spinning station 1 there is seen a device for starting the spinning operation or for joining or piecing a thread, which is designated by reference numeral 10. The device 10 can travel by means of rollers 10*a*, 10*b* on rails 10*c*, 10*d*. The device 10 has a driving arm 11 which is rotatable in a rotary pivot 11*a*. The end of the driving arm has a drive roller 12, which can be driven by a chain drive 11*b* and can swing along a circular arc 12*a*. The drive roller 12 can be driven in both directions of rotation by means of the chain drive 11*b*.

Another thread unwinding or take-off device which is disposed at the device 10 for starting the spinning operation or joining the thread, is formed of an unwinding or take-off roller 13 and a clamping roller 15. The clamping roller 15 is disposed at the end of a lever 15*a* which can be moved about a pivot point 15*b*.

The drive roller 12 and the unwinding roller 13 are driven synchronuously with the same circumferential velocity. A suction tube 14 is rotatably suspended at a pivot point 14*a*, so that a suction nozzle 14*b* thereof can swing along a circular arc 14*c*. A thread puller 16 can swing about a rotation point 16*a*. A thread gripper 16*b* of the thread puller 16 describes an arc 16*c* as the thread puller is moved. A grinding wheel or disc 20 serves for treating the thread which is guided back; this operation will be explained in detail below. Additionally, a thread regulator or feeder 17 pivots about a rotary pivot 17*a* and a thread lifter 18 is fastened to the thread regulator 17 at a rotary pivot 18*a*. The thread lifter 18 can be controlled by an articulatingly mounted coupler 19. The coupler 19 is articulatingly connected by a rotary pivot 19*a* with the housing of the device 10 for starting spinning or for splicing the thread. The head end 31 of the thread regulator 17 can swing along a circular arc 17*c*.

Figure 5:
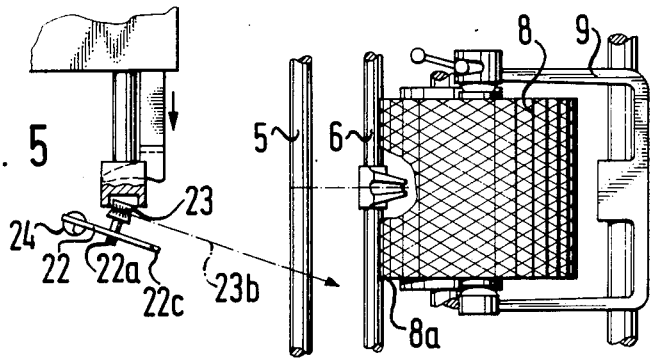
FIG. 5 is a fragmentary, top-plan view of the spinning station and the device for starting the spinning operation or piecing the thread.

Below the feed roller 13 is a throw off or releasing device 21, which can slide perpendicularly to the plane of the drawing. The throw off device 21 functions by throwing the thread which is on the unwinding roller 13 onto a roller 23 of a thread transfer device 22 at the proper time (as seen in FIG. 5). The thread transfer device 22 can swing about a rotary pivot 22*a*. The device 22 includes a lever 22*b*, having a restoring spring 24 attached at the end thereof. The other end of the restoring spring 24 is fastened to an adjusting screw 25. The force of the spring can be adjusted with the adjusting screw 25. The roller 23 of the thread transfer device 22 can swing along a circular arc 23*a*.

When the thread transfer device 22 swings into an end position toward the left in FIG. 1, the effective length of the lever or moment arm of the lever 22*b* changes, so that the effect of the restoring spring 24 on the thread transfer device 22 is reduced. Once the thread transfer device reaches its other end position, an additional lever 22*c* thereof operates a switch 26.

A stop pin 26*a* prevents the thread transfer device 22 from being moved too far back by the force of the restoring spring 24. FIG. 5 shows that the rotary pivot 22*a* is oriented at a slant, so that the roller 23 can swing under an end 8*a* of the winding bobbin 8.

FIGS. 7 and 8 shows the partially sectioned head end 31 of the thread regulator 17.

FIG. 8 is a cross section through a controllable thread gripper or clamp 65 which is positioned at the head end 31 of the thread regulator 17. The thread gripper 65 is formed of a roller pair made up of rollers 63 and 64. The roller 64 is supported in a housing 66 and carries a worm gear 67 at the end thereof. The roller 63 is supported in an angular lever 68, which can swing about a pin 69. A pin or projection 70 on the angular lever 68 is engaged by a fork-shaped part 71 of a second angular lever 72 which is supported in the housing 66. The angular lever 72 is fastened to a shaft 73. The angular lever 72 is loaded by a tension spring 74, so that the roller 63 is elastically pressed against the roller 64. By turning the shaft 73, the roller 63 is lifted from the roller 64 and the clamping action of the thread gripper 65 can thereby be released.

FIG. 7 shows that a drive motor 75 is attached to the housing 66 with a flange. A worm 77 sits on a shaft 76 of the motor 75 and engages the worm gear 67. The number of revolutions or speed of the drive motor 75 can be regulated, so that the circumferential velocity of the roller 64 is equal to the circumferential velocity of the unwinding roller 3.

FIG. 7 also shows that a device 32 is provided above the controllable thread gripper 65 which combines the functions of a thread monitor and a test of the spinning start or splice. The device 32 has a measuring range or distance 35 from a thread guide contour 33 to a thread guide contour 34. Inside the measuring range 35 is a measuring element 36 which responds to the presence or absence of a thread and also responds to thicker or thinner sections of the thread 2, as the thread passes by. The element 36 is a conventional optoelectric measuring sensor, which has a functional or operative connection 37 to a pre-amplifier 38. Three evaluation channels branch off from the pre-amplifier 38. An evaluation channel 39 evaluates the presence or absence of the thread and generates a corresponding signal. An evaluation channel 40 examines the signals received for the presence of a thick portion of the thread and sends out a signal if a thick spot is detected. An evaluation channel 41 examines the signals for the presence of thin spots and sends out a signal if it detects a thin section. The device 32 including the measuring element 36 and the evaluation channel 39 may also be referred to as a second thread monitor and the elements 36, 40 and 41 may be referred to as a thread joint tester.

Functional or operative connections lead from the evaluation channels 38, 39, 40 to non-illustrated regulating and signalling devices. In particular, there is one functional or operational connection from the evaluation channel 39 to a stopping device in the rotor spinning device 1*a* for sliver or slubbing or roving 2*b*.

The device for starting the spinning operation or joining or attaching the thread will be further explained with the aid of the motion or control diagrams in FIG. 6 and the remaining drawings.

FIG. 6 shows the time t on the abscissa and the motions or control of the parts 4, 11 to 17, 21, 22 and 65 on the ordinate, according to a sequence control plan or program.

FIG. 1 shows the location of all of the parts during the undisturbed spinning operation. The sliver 2*b* is conducted from a can *2a* to the rotor spinning device 1*a*. The thread 2 is generated in the rotor 1*b*, is conducted through a feed or withdrawal tube 28 and is pulled out with constant speed by the unwinding device 3, 4. A lifter 27 which can pivot at a rotary pivot 27*a*, serves for lifting the clamping roller 4, which is fastened to a lever 4*a* that is pivotable at a rotary pivot 4*b*; in FIG. 1, these elements are shown in the rest position.

If the spinning operation is interrupted and a new spinning start or thread joining is required, the machine looks the same, with the difference that the thread 2 is missing and the thread end is disposed on the winding bobbin 8. The feeding of sliver 2*b* is blocked in this case.

Figure 2:
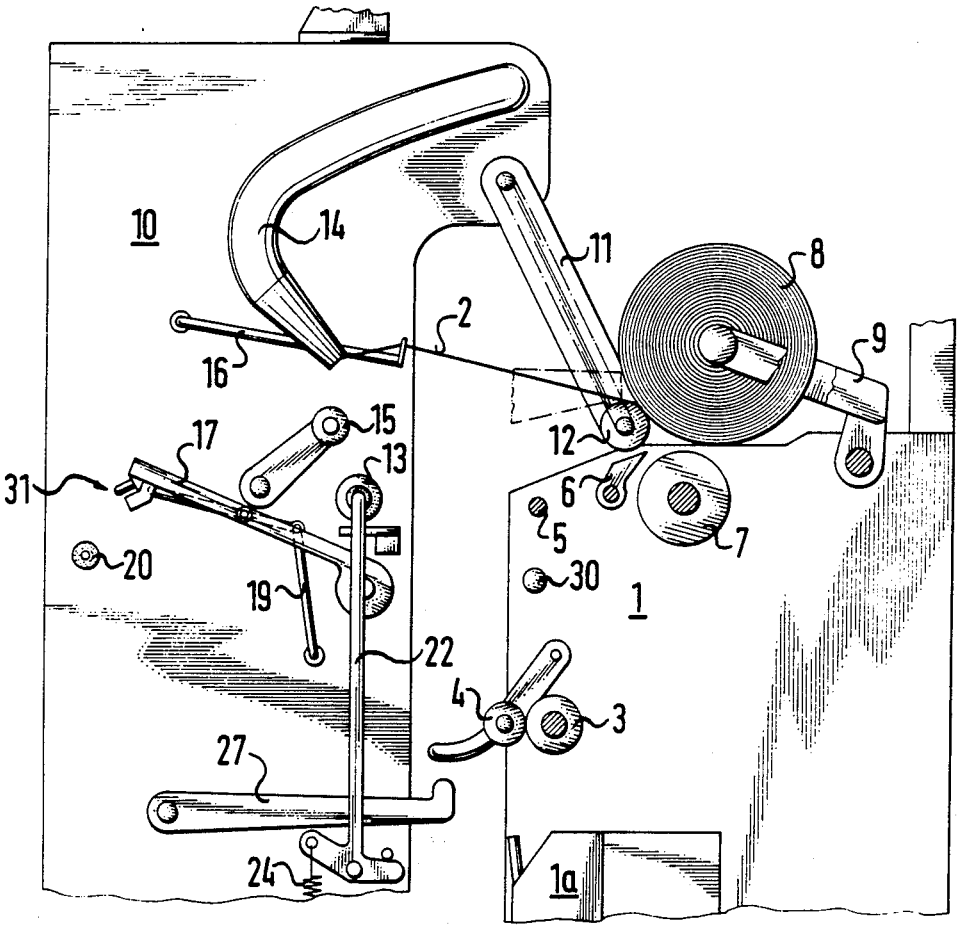
FIGS. 2 through 4 are views similar to FIG. 1 of the same spinning station and the same device for starting the spinning operation or joining the thread at different points in time during the spinning start or joining.

Upon a command to start the spinning operation or piece the thread, which is given a time point A according to FIG. 6, the driving arm 11 swings toward the winding bobbin 8. Then, at the time point B, the suction arm 14 also swings toward the winding bobbin 8. Subsequently, at the time point C, the drive arm 11 has reached the winding bobbin 8, the drive roller 12 begins to rotate backward. The roller 12 therefore lifts the winding bobbin 8 from the winding roller 7 and rotates it against the winding direction. At the same time, the unwinding roller 13 is also turned on in reverse direction. At the time point D, the suction arm 14 has approached so close to the winding bobbin 8, that the suction nozzle 14*b* is positioned quite near the surface of the bobbin. The thread end is searched for on the surface of the bobbin until the time point E and it is sucked in by the suction nozzle 14*b*. After this has been accomplished, the suction arm 14 swings back again until the time point F and thereby takes along the thread 2 as shown in FIG. 2. At the same time, the drive roller 12 and the unwinding roller 13 are turned off. The unwinding roller 13 has not touched the thread up to this point, and has only been turning because it is turned on and off in synchronization with the drive roller 12.

Figure 3:
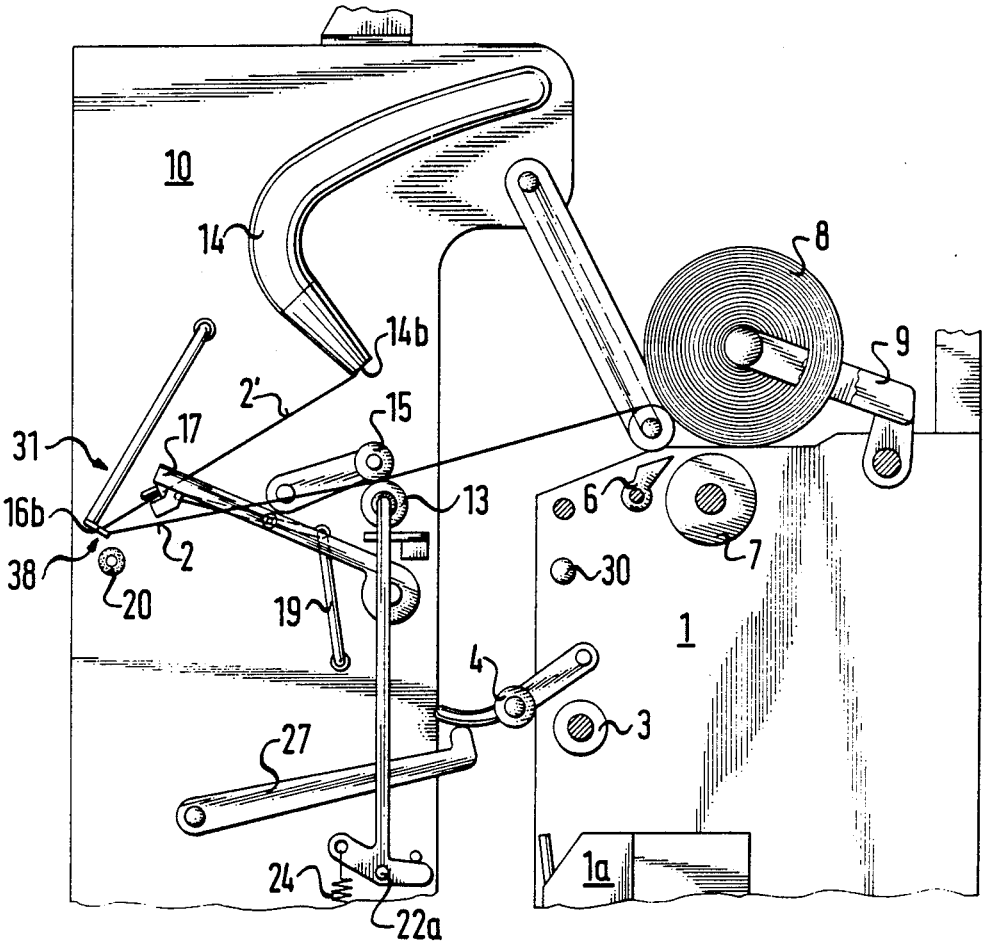

From the time point F to the time point G, the thread puller 16 swings upward and grips the thread 2, and then it swings back until the time point H, so that it pulls a thread loop in a "thread in readiness" position 38, as shown in FIG. 3. The thread 2 thus leads from the winding bobbin 8, between the clamping roller 15 and unwinding roller 13 of the other thread unwinding device and to the thread gripper 16*b* which is located at the "thread in readiness" position. From there, the thread end 2' extends up to the suction nozzle 14*b*. At the time point H, the clamping roller 15 is moved toward the unwinding roller 13 and the thread regulator 17 is set in motion. Simultaneously, the thread gripper 65 is opened by retracting the roller 63 from the roller 64. At the same time, the clamping roller 4 is also lifted by the lifter 27 from the unwinding roller 3, as shown in FIG. 3. At the time point I, the thread 2 is clamped between the unwinding roller 13 which is still stopped and the clamping roller 15. The thread unwinding device 3, 4 of the spinning station is thus fully opened. Meanwhile, the thread regulator 17 has swung a small distance downward, in particular it has moved so far that the thread gripper 65 lies in front of the grinding wheel 20. The thread gripper 65 and device 32 have then picked up the thread 2. At the time point I, the thread gripper 65 is closed again. While the coupler 19 is standing still, the thread lifter 18 is swung out by the moving thread regulator 17 as shown in phantom in FIG. 4, in order to guide the thread.

The running grinding wheel 20 makes contact with the thread, cuts the thread and prepares the new thread end for starting the spinning operation or joining the thread by loosening the fibers and pointing the end. The old thread end 2' is sucked away by the suction nozzle 14*b* and is removed.

Figure 4:
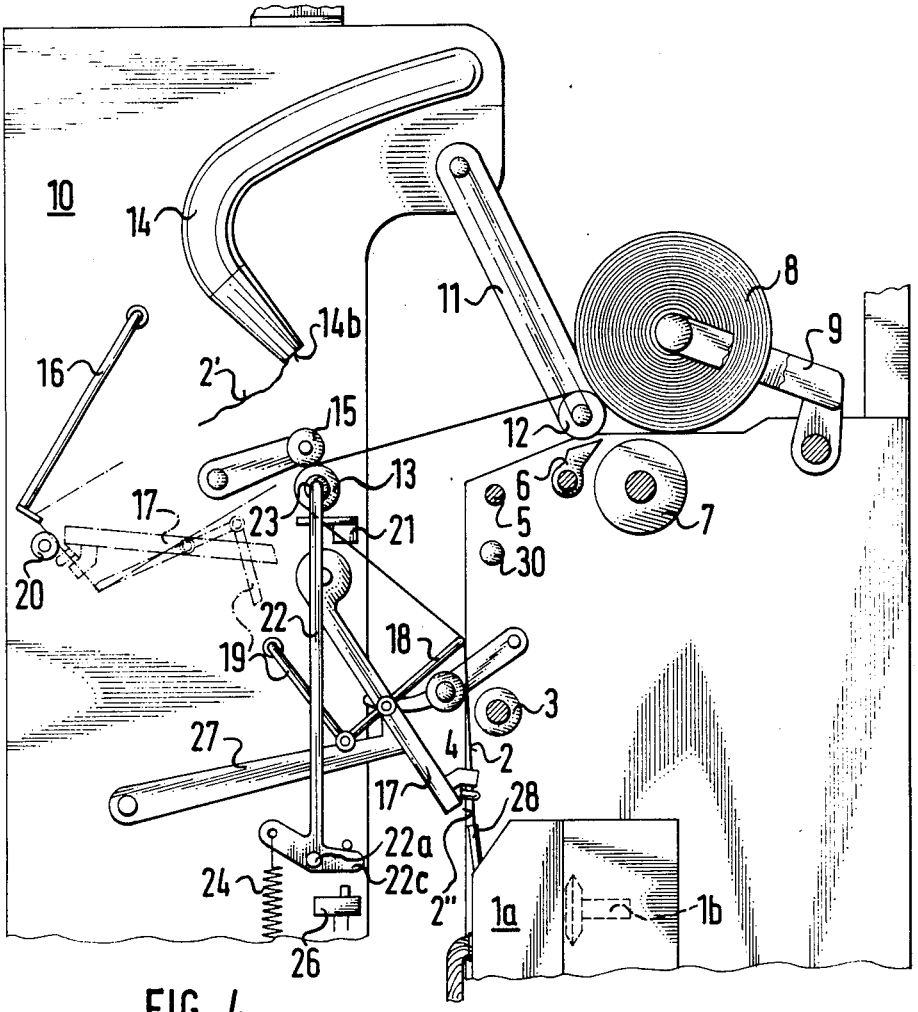

At the time point J, the drive roller 12 and the unwinding roller 13 are shifted to slow reverse operation. Simultaneously, the thread regulator 17 begins to swing further down on its circular path 17*c*. At the time point K, this swinging motion has ended, as shown in FIG. 4. The still closed thread gripper 65 of the thread regulator 17 is then positioned in front of the opening of the feed tube 28 of the rotor spinning device 1*a*. The thread lifter 18 which is controlled by the coupler 19, has taken a position perpendicular to the thread regulator 17 and has therefore laid the thread 2 into the opened thread unwinding device 3, 4 of the spinning station 1. At the time point K, the closed thread gripper 65 is shifted for thread return. At the same time, the new thread end 2" is sucked into the feed tube 28, as seen in FIG. 4. Simultaneously, the drive roller 12 and the unwinding roller 13 are shifted to a slightly faster reverse motion, corresponding to the thread return speed of the rollers 63, 64 of the thread gripper 65.

At the time point L, the thread end has almost reached the rotor groove of the rotor 1*b*. At the time point L, the thread gripper 65 is stopped and opened. The driver roller 12 and unwinding roller 13 are stopped between the time points L and M and immediately thereafter between the time points M and N they feed back a remaining piece of thread into the rotor 1*b* with fast reverse rotation, so that the actual spinning start or thread piecing is initiated.

At the time point N, the rotational directions of the drive roller 12 and the unwinding roller 13 are reversed and rapidly increased up to a predetermined operating speed for unwinding the thread. At time point O, the drive roller 12 and the unwinding roller 13 are rotating at high speed, but have not yet reached their final speed. The device 32 is aligned with the thread and is ready to take measurements at this point, at the latest.

At the time point P, the operating speed for unwinding the thread has been reached, i.e. the unwinding rollers 3 and 13 have the same circumferential speed. (The winding roller 3 rotates continuously with the normal thread unwinding velocity).

Between the time points P and Q, the lifter 27 is moved back again, so that the clamping roller 4 lies against the unwinding roller 3.

The thread 2 can then be transferred to the thread guide 6. For this purpose, at time point Q, the clamping roller 15 is lifted from the unwinding roller 13 and the throw off device 21 is set in motion. The throw off device 21 pushes the thread 2 laterally off the unwinding roller 13, so that it slides onto the roller 23 of the thread transfer device 22. After this is accomplished, at the time point R, the thread transfer device 22 begins to swing across in the direction toward the spinning station 1. This motion ends at the time point S. Between the time points R and S the drive roller 12 and the unwinding roller 13 are shifted to fast forward rotation. This is necessary in order to enable the winding bobbin 8 to accept the additional thread length created by the swinging motion of the thread transfer device 22 with unchanged or slightly increased thread tension. At this point in time, the unwinding roller 13 actually performs no function and freewheels empty, because it is shifted synchronuously with the drive roller 12, for reasons of simplicity. In this case, the motion of the thread transfer device 22 is effected by the tension of the thread against the force of the adjustable spring 24. The spring 24 is attached in such a way that the force component acting in the deflection direction decreases with the increasing excursion of the thread transfer device 22. This is advantageous because the wrap around angle of the thread and therefore the effective force component of the thread tension also decreases with the increasing excursion. In the end position of the thread transfer device 22, in which its roller 23 is in a posittion 23' according to FIG. 1, the additional lever 22c operates the switch 26 at the time point S. The switch 26 again shifts the drive roller 12 and the unwinding roller 13 to the normal thread feeding or drawing speed. Since the thread transfer device 22 deflects the thread 2 obliquely under the bobbin end 8a shown in FIG. 5, the thread initially slides off to the side of the drive roller 12, and at the time point S it is accepted by the thread guide 6 and is pulled laterally off the roller 23 of the thread transfer device 22.

After the thread transfer is finished, the thread transfer device 22 swings back to its starting position by the action of the restoring spring 24. After this is accomplished at time point T, the driving arm 11 and the thread regulator 17 begin to swing back. During the motion of the driving arm 11, after the winding bobbin 8 again lies on the winding roller 7, the drive roller 12 and the unwinding roller 13 are turned off again at the time point U. At the time point U, the thread gripper 65 is also closed again. When the driving arm 11 and the thread regulator 17 have reached their rest positions according to FIG. 1 at the time point V, the control program or plan is completed.

The program shifting mechanism is contained in the device 10 for starting the spinning operation or joining the thread and is not illustrated. For example, the program shifting mechanism can be an electromechanical device with cam discs.

If the device 32 should sense that there is no thread present, or that there is a thin portion or thick portion in the thread, the respective evaluation channel immediately gives display and warning command signals, which lead to a repetition of the spinning start or thread joining, for protection against damage to personnel or goods, and in some cases it also gives commands for cleaning the rotor. In particular, if it is noticed that the thread is missing, the evaluation channel 39 immediately sends a signal to the rotor spinning device 1a to cut off the fiber feed into the rotor 1b and to instantly interrupt the further feeding of the slubbing or sliver 2b.

We claim:

1. Open-end rotor spinning machine, comprising a plurality of spinning stations each including a first thread monitor monitoring a thread course and a rotor spinning device receiving a fiber supply and having a spinning element; an automatic thread joining device for joining a thread to be conducted to the rotor element, and a second thread monitor disposed on said automatic thread joining device for monitoring the thread course without placing a load on the thread when said first thread monitor is inoperative and said automatic thread joining device is operative, said automatic device including means for delivering said second thread monitor and a thread to a location directly adjacent said spinning element, and said second thread monitor including means for immediately interrupting fiber supply to said rotor spinning device if said second third monitor detects the absence of the thread.

2. Open-end rotor spinning machine according to claim 1, wherein said second thread monitor includes means for initiating a repetition of the operation of said automatic thread joining device, means for ending the operation of said automatic thread joining device after at least one unsuccessful repetition, and means for issuing a malfunction signal.

3. Open-end rotor spinning machine according to claim 1, wherein said delivering means includes a thread regulator having a head end on which said second thread monitor is disposed, and said spinning element is a rotor having a feed tube at said location.

4. Open-end rotor spinning machine according to claim 3, wherein said head end of said thread regulator also includes a thread joint tester measuring at least one of the thickness and thinness of the thread.

5. Open-end rotor spinning machine according to claim 4, wherein said second thread monitor and said thread joint tester are combined into one device.

6. Open-end rotor spinning machine according to claim 5, wherein said device combining said second thread monitor and said thread joint tester has a single measuring range and a measuring element responding to the absence of the thread and to thicker and thinner portions of the thread for activating said interrupting means, for activating a repetition of the operation of said automatic thread joining device, for ending the operation of said automatic thread joining device after at least one unsuccessful repetition of the operation of said thread joining device, and for issuing a malfunction signal.

* * * * *